US005413680A

United States Patent [19]

Nunn

[11] Patent Number: 5,413,680

[45] Date of Patent: May 9, 1995

[54] MICROBIOLOGICAL DETECTION METHOD FOR FELTS USING IODONITROTETRAZOLIUM

[75] Inventor: Maureen B. Nunn, Naperville, Ill.

[73] Assignee: Nalco Chemical Company, Naperville, Ill.

[21] Appl. No.: 100,755

[22] Filed: Aug. 2, 1993

[51] Int. Cl.[6] ..... D21F 1/32

[52] U.S. Cl. ..... 162/274; 162/199

[58] Field of Search ..... 162/199, 274; 436/165

[56] References Cited

U.S. PATENT DOCUMENTS 4,102,707 7/1978 Lange ..... 162/161

*Primary Examiner*—W. Gary Jones
*Assistant Examiner*—Dean T. Nguyen
*Attorney, Agent, or Firm*—Robert A. Miller; James J. Drake

[57] ABSTRACT

A method of detecting microbiological fouling of felts used in paper making machines is described. A felt suspected of containing microbiological deposits is contacted with iodonitrotetrazolium and then examined for a predetermined color change confirming the presence of bacteria on the felt. The felt assumes a red color in the presence of at least one million colony forming units of bacteria per gram of dry felt within thirty minutes after the iodonitrotetrazolium has contacted the felt.

8 Claims, No Drawings

MICROBIOLOGICAL DETECTION METHOD FOR FELTS USING IODONITROTETRAZOLIUM

FIELD OF THE INVENTION

The present invention relates generally to methods for detecting microbiological fouling of felts used in a paper making process. This invention particularly relates to addition of iodonitrotetrazolium to the felts to affect a color change in the felts if a particular amount of bacteria is present.

BACKGROUND OF THE INVENTION

Paper making machinery includes the use of felts to dewater paper sheets. In a paper making process, a slurry of paper making components is deposited on a fabric through which the liquid components are extracted to provide a continuous paper sheet. The paper sheet is transported on a continuous press felt to a pair of rollers where the sheet and felt pass between the nip of the rollers to dewater the paper sheet. The felts, generally composed of polyamides such as nylon, tend to accumulate microbiological deposits during use. The deposits eventually plug the channels within the felt which carry water away from the sheet resulting in less effective, nonuniform dewatering of the paper sheet.

Plugging of the channels of a felt causes a variety of paper defects including crushing, picking, poor drainage, sheet following, sheet pickup and blowing. A crush in the paper sheet occurs when water is pressed out of the channels at a higher rate than the sheet can allow. Plugging may also result in picking where the sheet fibers adhere to a felt as the sheet and felt are separated. A thin film of water can form between the sheet and felt such that the sheet follows the felt on the outgoing side of a press nip. Pickup problems associated with the transfer of a web of paper from a fourdrinier wire to a felt that carries the web to the presses are also influenced by plugging of the felt. The felt may also be subject to blowing, a localized accumulation of air from the felt which causes an air bubble between the sheet and the felt. Microbiological deposits can also form on a felt and plug it. The problems associated with felt plugging due to microbiological deposits can be alleviated by treating the felt with a biocide to remove or prevent the deposits.

Microbiological fouling of felts is commonly caused by aerobic and anaerobic bacteria, yeast, mold, blue green algae (cyanobacteria), green algae, diatoms, protozoa and the like. Species of bacteria and fungi which are commonly isolated from paper making felts include *Chaetonium sp., Aspergillus niger, Penicillium sp. Trichoderma sp., Alternaria sp., Bacilus subtilis, Bacillus megatherium, Pseudomonas sp., Proteus sp.,* and *Brevibacterium sp.* Although these deposits can be removed from a fouled felt by treating the felt with a biocide, conventional means for identifying microbiological contamination cannot detect fouling in felts.

Microbiological contamination of paper is usually detected by spraying the paper with ninhydrin. The ninhydrin changes to a pink purple color upon reacting with degraded protein matter or amino acids. When ninhydrin is applied to a felt, however, it reacts with the nylon felt to form a blue color which obscures the pink purple color change.

The stain 2-(p-idiophenyl)-3-(p-nitrophenyl)-5-phenyl-tetrazolium chloride, hereinafter referred to as iodonitrotetrazolium, has been used extensively in histochemical research. The colorless compound forms a red formazan when it is reduced due to aerobic or anaerobic respiration. Iodonitrotetrazolium has been used to detect microorganisms in the water or pulp of a papermaking process by measuring UV absorption.

There is a need for an indicator which directly detects microbiological contamination on papermaking felts in order to identify fouling of the felt before the channels of the felt become clogged.

SUMMARY OF THE INVENTION

In order to satisfy the need for an effective detector of microbiological deposits which detects the presence of bacteria without reacting with the felts, one aspect of the present invention provides a method of detecting microbiological fouling of felts used in paper making machines. A felt suspected of containing microbiological deposits is contacted with iodonitrotetrazolium and then examined for a predetermined color change in the felt confirming the presence of bacteria on the felt. The felt assumes a red color in the presence of at least one million colony forming units of bacteria per gram of dry felt within thirty minutes after the iodonitrotetrazolium has contacted the felt.

It is an object of this invention to provide a visual detection method for an on-line determination of whether paper making felts are fouled with bacteria. An associated object of the invention is to provide a detection method which detects the presence of microbiological fouling within a short time period so that the paper making process is not delayed.

It is another object of this invention to provide a detection method wherein the detecting material does not react with the felt so that a color change will not be obscured.

Other objects will be apparent to those skilled in the art from the disclosure herein.

DETAILED DESCRIPTION OF THE INVENTION

The present invention provides a method for removing microbiological deposits from a felt used in a papermaking process. An effective amount of iodonitrotetrazolium is added to the felt. An effective amount of iodonitrotetrazolium is an amount sufficient to effect a red color change in the presence of at least one million colony forming units of bacteria per gram of dry felt. The removal of microbiological fouling cleans the felts such that less plugging occurs and felt life is increased. Iodonitrotetrazolium indicator also provides a visual detection method allowing on-line determination of bacterial fouling by applying the indicator directly on the felt. The indicator detects fouling within thirty minutes of application to the felt, resulting in less delay in resuming the paper making process. Iodonitrotetrazolium is also inert with respect to the nylon felt, ensuring that the indicator will not react with the felt and obscure a color change. The method does not destroy the felt and does not require the use of costly field equipment.

Iodonitrotetrazolium can be added to any portion of a felt when the paper making machinery is stopped. The proper dosage of iodonitrotetrazolium ranges from about 0.05 to about 0.2 g/l, preferably from about 0.075 to about 0.125 g/l. Iodonitrotetrazolium is commercially available from Schweizerhall, Inc. of Piscataway, N.J. The aqeuous iodonitrotetrazolium solution can also contain sodium acetate in an amount ranging from about 0.1 to about 0.5 g/l.

The iodonitrotetrazolium solution is colorless until contacted with at least one million colony forming units of bacteria per gram of dry felt. The iodonitrotetrazolium reacts to form a red formazan within a thirty minute time period after contact with the bacteria. A greater amount of bacteria present on the felt will cause the red color change to occur more rapidly than it will with a lesser amount of bacteria. Less than one million colony-forming units of bacteria per gram of dry felt will not result in a color change. The method of the present invention detects only living bacteria. The iodonitrotetrazolium indicator must be kept in the dark prior to use, and will not detect fouling in the presence of reducing agents. The color of the felt may affect the ability to detect microorganisms, particularly if the felt has a red coloring.

If the iodonitrotetrazolium indicator undergoes a red color change, the felt can be treated with a biocide to remove the microbiological fouling. The dosage and composition of the biocide which is added to the felt is well known in the art.

The following examples are presented to describe preferred embodiments and utilities of the present invention and are not meant to limit the present invention unless otherwise stated in the claims appended hereto.

EXAMPLE 1

Ten drops of an aqueous solution containing 0.1 g/l iodonitrotetrazolium and 0.5 g/l sodium acetate was placed on a microbiologically fouled felt. The solution turned a red color indicating a positive test for fouling within ten minutes. An identical unused, uncontaminated felt was wetted with the same solution and did not develop color. A dried chemically contaminated felt that was wetted with the same solution also showed no color change. Dried felts should not contain significant amounts of bacteria.

These results indicate that microbiological contamination can be detected on felts using iodonitrotetrazolium. Chemical contaminants in the used felts did not interfere with the indicator. The felts did not react with the indicator.

EXAMPLE 2

A test was developed to determine the total colony forming units per gram of dry felt which will cause a positive color reaction of the iodonitrotetrazolium indicator.

Two identically fouled three gram felts were obtained for at each determination of total bacteria count and color change. Initially, the felts were sterilized in an autoclave for thirty minutes. The felts were then kept in the same container with the same exposed surface areas. A solution containing 5 g/l casitone, 10 g/l glycerol, 1 g/l yeast extract and 0.001 g/l ferric chloride was sterilized in an autoclave for fifteen minutes. The solution was added to the container in an amount of 130 ml to cover the felts. The felts were identically inoculated with a loop having an *Escherichia coli* culture. Three of these containers were placed on an incubator shaker for three, 24 and 48 hours, respectively. At these time intervals, the felt samples were analyzed for color and number of total colony forming units.

One of the felt samples in each of the containers was placed in a petri dish at room temperature and was treated with one milliliter of the iodonitrotetrazolium indicator solution described in Example 1. The felt was incubated for thirty minutes to allow for color development. The results are shown below in Table 1. The felt should not be incubated for an extended time because color enhancement may occur with time as the felt is exposed to bacteria in the air.

The conventional paper disintegration test was adapted to determine bacteria counts. The remaining felt sample from each container was cut and ground in a sterile blender. A uniform suspension was achieved by cutting the felts into very small pieces (0.5×0.5 cm), adding 300 g sterile phosphate buffered water (1 g $N_2HPO_4$/g $K_2PO_4$ per liter) and adding 0.1% Tween 80 during grinding. Any dispersant that is not toxic to bacteria can be used to replace the Tween 80 informing the suspension. The resulting solution was plated on TGE agar in triplicate using standard dilution plating techniques. The total bacteria count and associated color for each sample is listed below in Table 1. The total count sampling is performed within 48 hours after inoculation because the bacteria population can decrease when nutrients are depleted.

TABLE 1

| Sample No. | Replicate No. | Incubation Time (Hours) | Bacteria Count | Color |
|---|---|---|---|---|
| 1 | 1 | 3 | 10,000 | None |
| 2 | 2 | 3 | 20,000 | None |
| 3 | 3 | 3 | 30,000 | None |
| 4 | 1 | 24 | 100,000,000 | Red |
| 5 | 2 | 24 | 100,000,000 | Red |
| 6 | 3 | 24 | 2,000,000,000 | Red |
| 7 | 1 | 48 | 1,150 | None |
| 8 | 2 | 48 | 1,120 | None |
| 9 | 3 | 48 | 1,130 | None |

As shown above, iodonitrotetrazolium detects a million colony forming units of bacteria. Below a million bacteria, no color change was observed. Above a million bacteria, a distinct color change appeared.

While the invention is susceptible to various modifications and alternative forms, specific embodiments thereof have been shown by way of example and were herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims. The method of the present invention can be used to determine microbiological contamination of other fabrics which do not affect a false color change by reaction of iodonitrotetrazolium with the fabric.

I claim:

1. A method of detecting microbiological fouling of felts used in paper making machines, the method comprising the steps of: contacting a felt suspected of containing microbiological deposits with iodonitrotetrazolium; and then examining the felt for a predetermined color change in the felt confirming the presence of bacteria on the felt;

and wherein the felt assumes a red color in the presence of at least one million colony forming units of bacteria per gram of dry felt.

2. The method of claim 1 wherein the predetermined color change occurs within thirty minutes after the iodonitrotetrazolium has contacted the felt.

3. The method of claim 1 further including the step of treating the felt with a biocide after the presence of at least one million colony forming units of bacteria per gram of dry felt has been detected.

4. The method of claim 1 wherein the iodonitrotetrazolium is an aqueous solution containing from about 0.05 to about 0.2 grams iodonitrotetrazolium per liter.

5. The method of claim 4 wherein the solution further includes from about 0.1 to about 0.5 gram sodium acetate per liter.

6. A method of removing microbiological deposits from paper making felts, the method comprising the steps of:

contacting a felt suspected of containing microbiological deposits with iodonitrotetrazolium;

examining the felt for a predetermined color change in the felt confirming the presence of at least one million colony forming units of bacteria per gram of dry felt;

and treating the felt with a biocide when the presence of at least one million colony forming units of bacteria per gram of dry felt is detected.

7. The method of claim 6 wherein the iodonitrotetrazolium is an aqueous solution containing from about 0.05 to about 0.2 grams iodonitrotetrazolium per liter.

8. The method of claim 6 wherein the solution further includes from about 0.1 to about 0.5 gram sodium acetate per liter.

* * * * *